US007597571B2

(12) United States Patent
Chen et al.

(10) Patent No.: US 7,597,571 B2
(45) **Date of Patent: *Oct. 6, 2009**

(54) FAN AND PLUG THEREOF

(75) Inventors: Tien-Min Chen, Taoyuan Hsien (TW); Te-Tsai Chuang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/041,316

(22) Filed: Mar. 3, 2008

(65) Prior Publication Data

US 2008/0261439 A1 Oct. 23, 2008

(30) Foreign Application Priority Data

Apr. 17, 2007 (TW) ..... 96113435 A

(51) Int. Cl.
*H01R 29/00* (2006.01)

(52) U.S. Cl. ..... 439/173; 439/534

(58) Field of Classification Search ..... 439/171–174, 439/467, 534, 596

See application file for complete search history.

(56) References Cited

U.S. PATENT DOCUMENTS 4,625,259 A * 11/1986 Krechmer et al. ..... 361/610
6,190,197 B1 * 2/2001 Polgar et al. ..... 439/527
6,447,587 B1 * 9/2002 Pillion et al. ..... 96/418
6,537,106 B1 * 3/2003 Follingstad ..... 439/534
6,544,069 B1 * 4/2003 Enriquez et al. ..... 439/534
6,550,977 B2 * 4/2003 Hizuka ..... 385/55
6,634,904 B2 * 10/2003 Rowland et al. ..... 439/534
6,683,786 B2 * 1/2004 Yin et al. ..... 361/679.4
7,134,902 B1 * 11/2006 Lewis et al. ..... 439/373
7,264,514 B2 * 9/2007 Hsu et al. ..... 439/640
7,455,548 B2 * 11/2008 Clark et al. ..... 439/534

* cited by examiner

*Primary Examiner*—Khiem Nguyen
(74) *Attorney, Agent, or Firm*—Muncy, Geissler, Olds & Lowe, PLLC

(57) ABSTRACT

The present invention provides a fan having a frame and a plug. The frame includes an accommodating portion and at least two fixed holes. Each of the fixed holes is disposed on the two sides of the accommodating portion. The plug has a terminal seat with at least two linking portions and a bipolar knife-shaped terminal between an top seat and a bottom seat of the terminal seat, and the plug so that the plug is assembled with the fixed holes of the frame via the linking portions of the plug and is accommodated within the accommodating portion of the frame.

20 Claims, 5 Drawing Sheets

FAN AND PLUG THEREOF

CROSS REFERENCE TO RELATED APPLICATIONS

This Non-provisional application claims priority under 35 U.S.C. §119(a) on Patent Application No(s). 096113435, filed in Taiwan, Republic of China on Apr. 17, 2007, the entire contents of which are hereby incorporated by reference.

BACKGROUND OF THE INVENTION

1. Field of the Invention

The present invention relates to a fan and a plug, and more particularly to a fan with a plug for quickly connecting to an external system and avoiding wire interference.

2. Description of the Related Art

With high development of the performance and the high operational speed of electronic or mechanical systems, heat generated by the systems relatively increases. A fan is used to dissipate heat from systems and keep the operational temperature within normal ranges.

Referring FIG. 1, a conventional fan 1 is connected to an external system via a terminal 12 connected to an end of a set of wires 11. The external system, such as a motherboard, a printed circuit board or a mechanical device (not shown), for receiving power and driving signal. Because the wires 11 are configured with a predetermined or long length and system (not shown), the excess length of the wires 11 in the system causes interferences with other components or parts. Thus, reliability of the fan 1 decreases.

BRIEF SUMMARY OF INVENTION

A detailed description is given in the following embodiments with reference to the accompanying drawings. The present invention provides a plug of a fan. The plug is connected to a frame via a linking portion to allow the fan connect electrically and precisely to the external system.

The present invention provides a plug connected to a frame for fast assembly. The plug includes a terminal seat with at least two linking portions and a bipolar knife-shaped terminal. Each of the linking portions is disposed on each of the two sides of the terminal seat. The terminal seat includes a top seat and a bottom seat. The bipolar knife-shaped terminal is disposed between the top seat and the bottom seat.

The present invention provides a fan including a frame and a plug. The frame includes an accommodating portion and at least two fixed holes. Each of the fixed holes is disposed on each of the two sides of the accommodating portion. The plug includes a terminal seat with at least two linking portions and a bipolar knife-shaped terminal. The linking portions are disposed between two sides of the terminal seat and connected to the fixed holes. Thus, the terminal seat is disposed in the accommodating portion. The terminal seat includes an top seat and a bottom seat. The bipolar knife-shaped terminal is disposed between the top seat and the bottom seat.

The structure of the linking portions of the plug and the terminal seat of the fan of the present invention is provided of a frame to connect to the plug. The fan of the present invention is not only assembled fast but also prevents the excess length of the wires 11 in the system causing interferences with other components or parts. Compared with conventional fan designs, the fan of the present invention can more efficiently ensure the electrical connection of the fan and the external system, further improving reliability.

BRIEF DESCRIPTION OF DRAWINGS

The present invention can be more fully understood by reading the subsequent detailed description and examples with references made to the accompanying drawings, wherein.

DETAILED DESCRIPTION OF INVENTION

The following description is of the best-contemplated mode of carrying out the present invention. This description is made for the purpose of illustrating the general principles of the present invention and should not be taken in a limiting sense. The scope of the present invention is best determined by reference to the appended claims.

Figure 1:
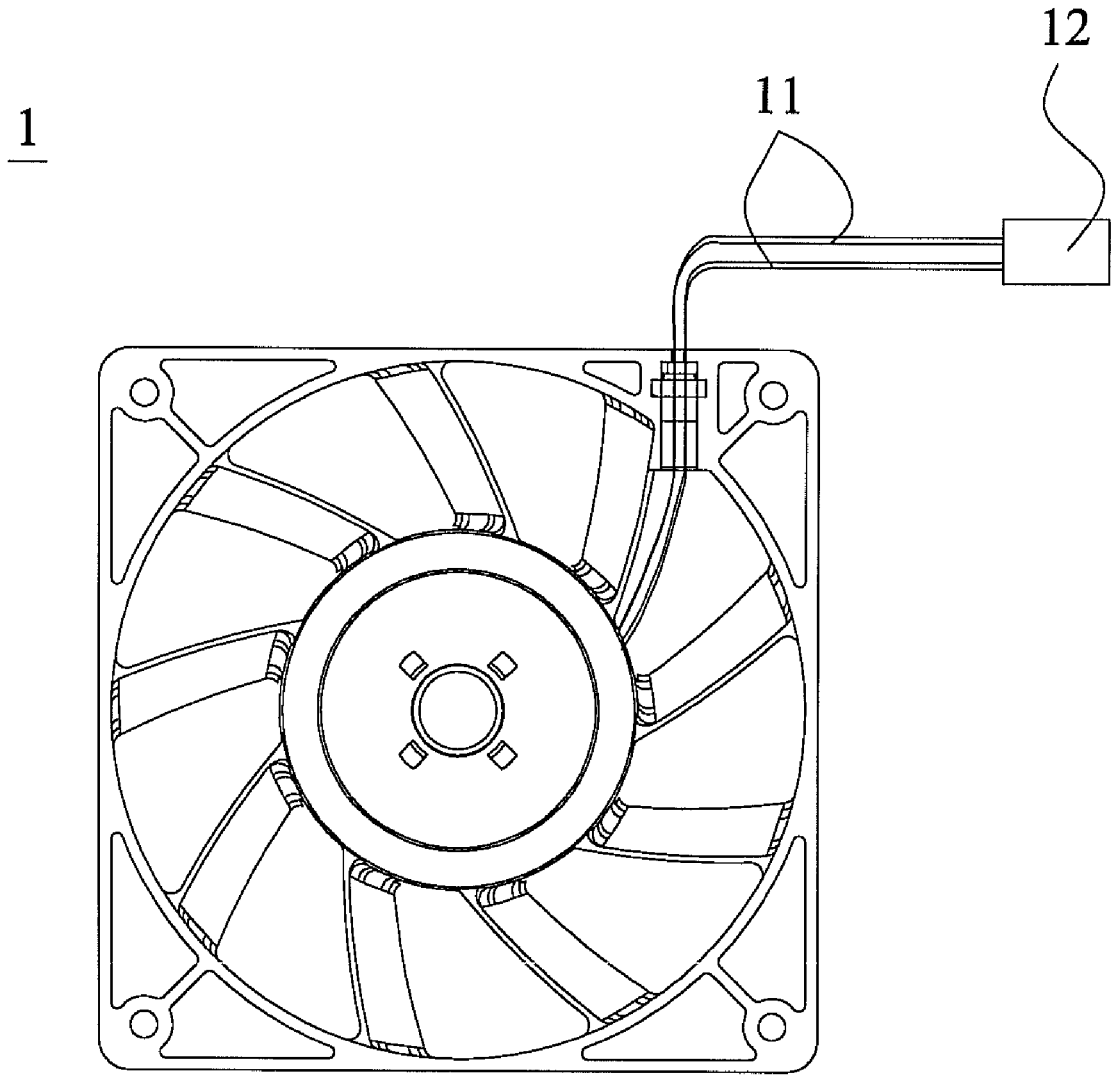
FIG. 1 (PRIOR ART)
FIG. 1 is a schematic illustration of a conventional fan.
Figure 2A:
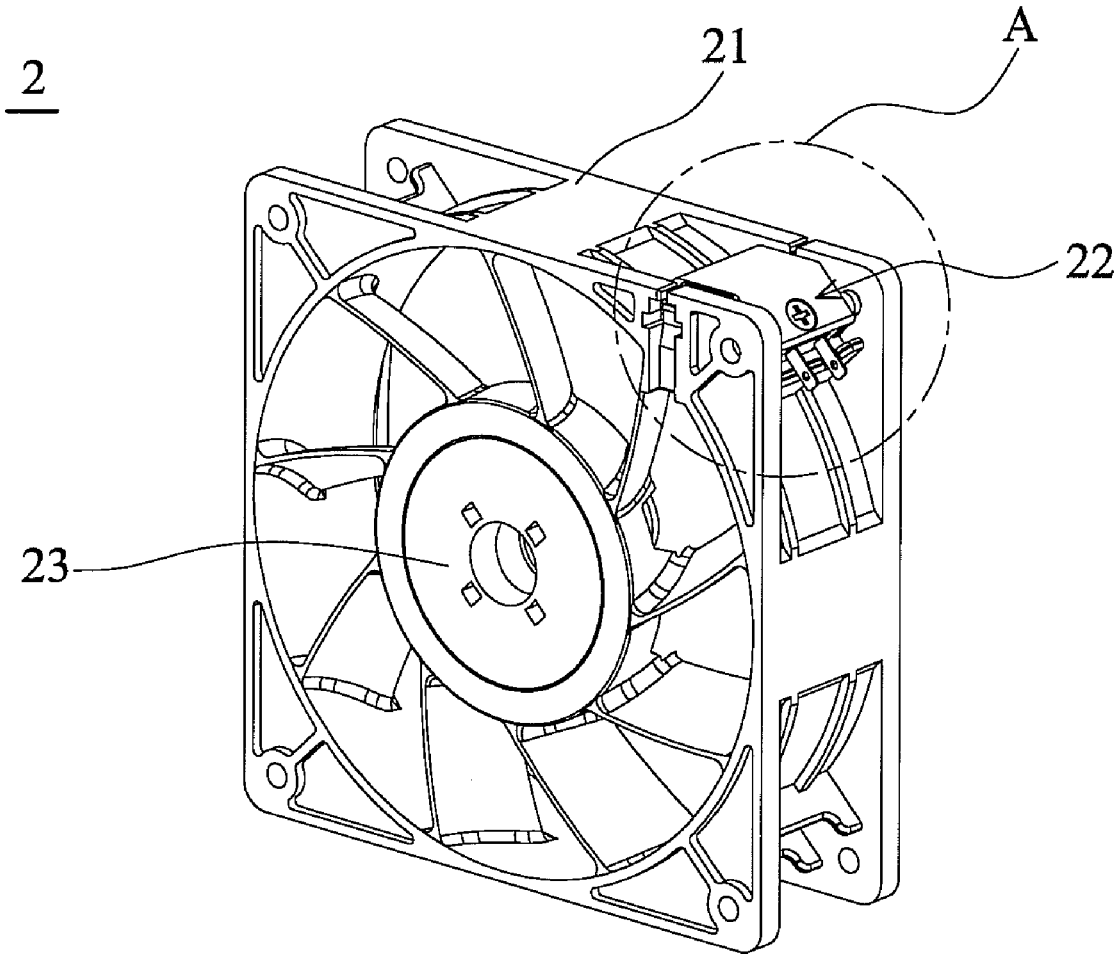
FIG. 2A is a schematic illustration of a fan of the present invention.
Figure 2B:
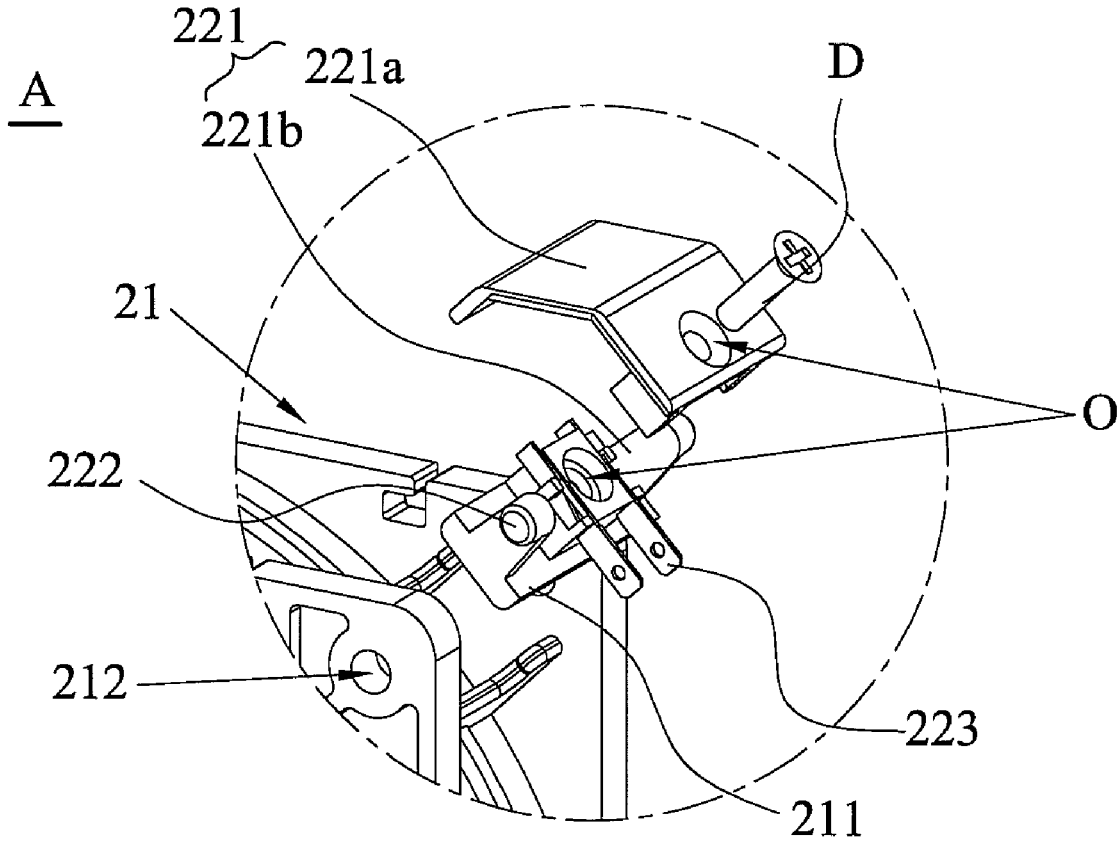
FIG. 2B is a partial enlarged view of FIG. 2A.

Referring FIGS. 2A and 2B, a fan 2 of an embodiment of the present invention includes a frame 21 and a plug 22. The fan 2 is an axial fan, for example. The frame 21 includes an accommodating portion 211 and two fixed holes 212. Each of the fixed holes 212 is disposed on each of the two sides of the accommodating portion 211, respectively. In this embodiment, the fixed holes 212 are disposed on two opposite sides of the accommodating portion 211, but the position is not limited to the disclosed embodiments.

The plug 22 includes a terminal seat 221 with at least two linking portions 222, a top seat 221*a* and a bottom seat 221*b*, and a bipolar knife-shaped terminal 223. Each of the linking portions 222 is disposed on each of the two sides of the terminal seat 221 and connected to each of the fixed holes 212 of the fan 21. Thus, the terminal seat 221 is disposed in the accommodating portion 211. The bipolar knife-shaped terminal 223 is disposed between the top seat 221*a* and the bottom seat 221*b*. The diameter of each fixed hole 212 is slightly larger than or equals to the diameter of each linking portion 222 so as to provide smooth assembly when assembling the linking portions 222 to the fixed holes 212.

Meanwhile, the depth of each fixed hole 212 is larger than or equals to the length of each linking portion 222, whereby preventing the linking portion 222 from protruding and interfering with other components or parts after assembling Each fixed hole 212 is formed as an elliptic cylinder, a cylinder, a cuboid or a polygon prism shape. Each linking portion 222 corresponding to the fixed hole 212 is formed as an elliptic cylinder, a cylinder, a cuboid or a polygon prism shape. However, the shapes are not limited to the disclosed embodiments.

Figure 3A:
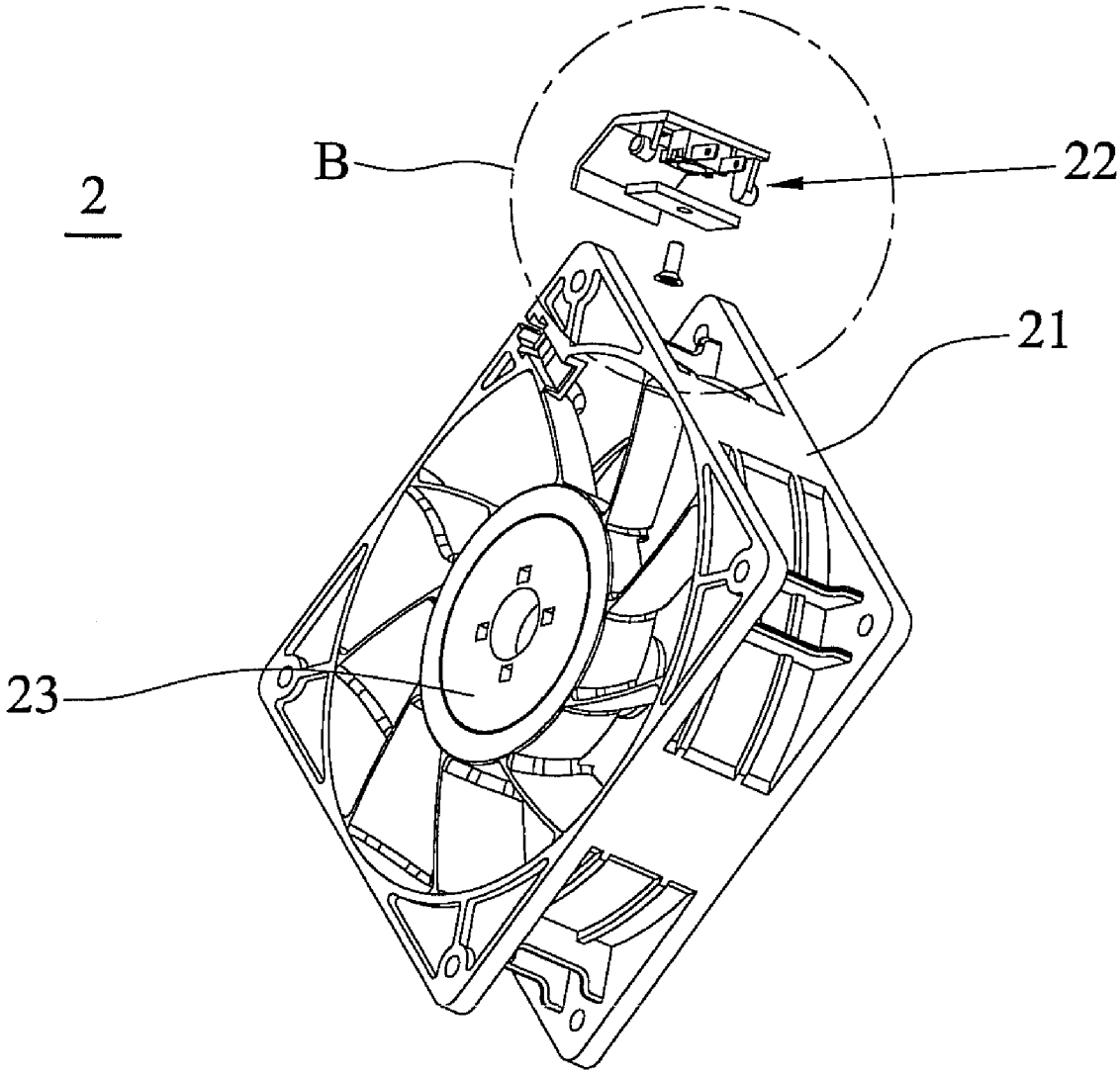
FIG. 3A is a schematic illustration of another embodiment of a fan of the present invention.
Figure 3B:
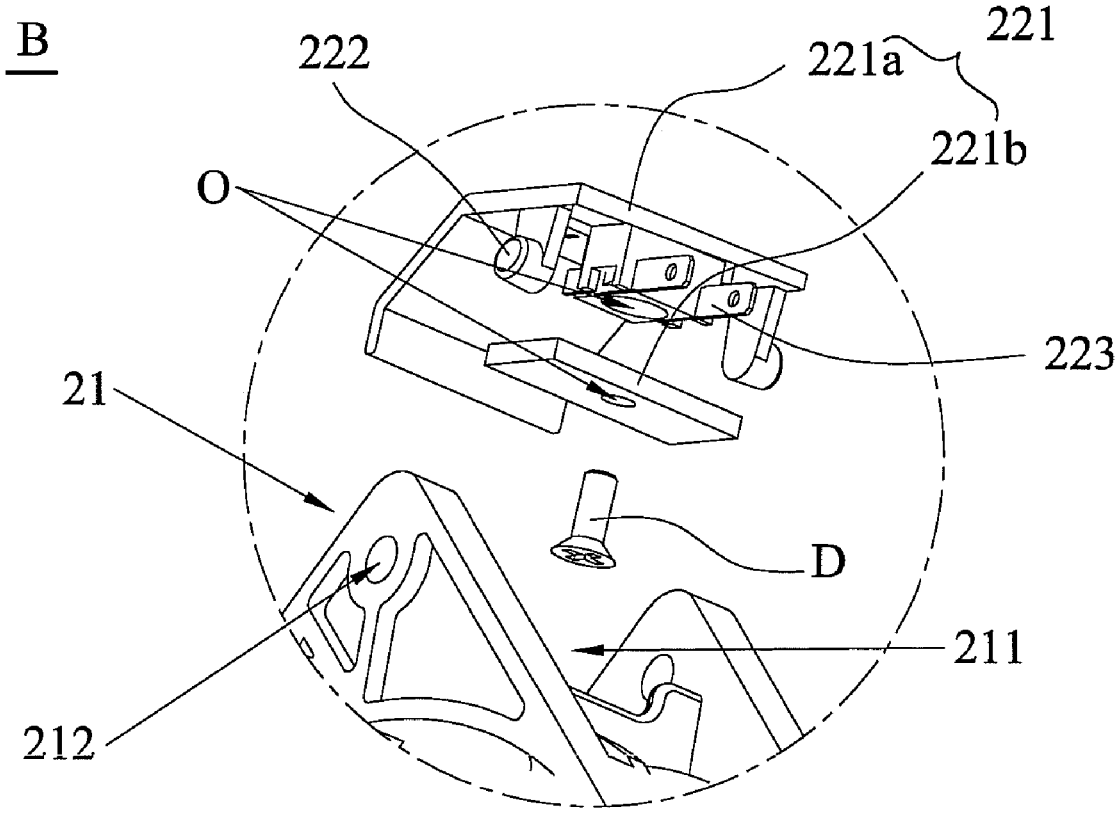
FIG. 3B is a partial enlarged view of FIG. 3A.

The linking portions 222 and the top seat 221*a* of the terminal seat 221 are integrally formed as a single piece (shown in FIGS. 3A and 3B) or the linking portions 222 and the bottom seat 221*b* of the terminal seat 221 are integrally formed as a single piece (shown in FIGS. 2A and 2B). The width of the terminal seat 221 is less than that of the accommodating portion 211 for smooth assembling of the terminal seat 221 with the accommodating portion 211.

The fan 2 of the present invention further includes a motor 23 electrically connected to the bipolar knife-shaped terminal 223 made of an electric conducting material. The top seat 221*a* and the bottom seat 221*b* respectively includes an opening O. A fixing element D passes through the openings O of the top seat 221*a* and the bottom seat 221*b* to connect to the terminal seat 221 and then clips to the bipolar knife-shaped terminal 223. The fixing element D may be a screw or a bolt, but it is not limited to the disclosed embodiments. When the linking portion 222 is disposed at the top seat 221*a*, the fixing element D passes through the opening O of the bottom seat 221*b* and then passes through the top seat 221*a* to clamp the bipolar knife-shaped terminal 223 therebetween (shown in FIGS. 3A and 3B). Finally, the plug 22 is engaged with the accommodating portion 211 and the assembly of the fan 2 is finished. On the contrary, when the linking portion 222 is disposed at the bottom seat 221*b*, the fixing element D passes through the opening O of the top seat 221*a* and then passes through the bottom seat 221*b* to clamp the bipolar knife-shaped terminal 223 therebetween (shown in FIGS. 2A and 2B). Finally, the plug 22 is engaged with the accommodating portion 211 and the assembly of the fan 2 is finished.

The structure of the linking portions of the plug and the terminal seat of the fan of the present invention is provided of a frame to connect to the plug. The fan of the present invention not only achieves fast assembling processes but also prevents the excess length of the wires in the system causing interference with other components or parts. Compared with conventional fan designs, the fan of the present invention can more efficiently ensure the electrical connection of the fan and the external system, further improving reliability.

While the present invention has been described by way of example and in terms of the preferred embodiments, it is to be understood that the present invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A plug, connected to a frame, the plug comprising:

a terminal seat comprising at least two linking portions; wherein each of the linking portions is disposed between two sides of the terminal seat for connecting with the frame; and a bipolar knife-shaped terminal;

wherein the terminal seat comprises a top seat and a bottom seat, and the bipolar knife-shaped terminal is disposed between the top seat and the bottom seat.

2. The plug as claimed in claim 1, wherein each linking portion is formed as an elliptic cylinder, a cylinder, a cuboid or a polygon prism shape.

3. The plug as claimed in claim 1, wherein the linking portions and the top seat of the terminal seat are integrally formed as a single piece, or the linking portions and the lower seat of the integrally terminal seat are formed as a single piece.

4. The plug as claimed in claim 1, wherein the terminal comprises an electric conducting material.

5. The plug as claimed in claim 1, wherein the top seat and the bottom seat respectively comprises an opening, and the opening of the top seat corresponds to the opening of the bottom seat.

6. The plug as claimed in claim 5, further comprising a fixing element passing through the openings of the upper seat and the lower seat.

7. The plug as claimed in claim 6, wherein the fixing element is a screw or a bolt.

8. A fan, comprising:

a frame comprising an accommodating portion and at least two fixed holes, the fixed holes disposed at two sides of the accommodating portion, respectively; and a plug, comprising:

a terminal seat comprising at least two linking portions; wherein each of the linking portions is disposed between two sides of the terminal seat for connecting with the frame; and a bipolar knife-shaped terminal;

wherein the terminal seat comprises a top seat and a bottom seat, and the bipolar knife-shaped terminal is disposed between the top seat and the bottom seat.

9. The fan as claimed in claim 8, wherein a diameter of each fixed hole is larger than or equals to a diameter of each linking portion.

10. The fan as claimed in claim 8, wherein each of the fixed holes is disposed corresponding to each of the linking portions.

11. The fan as claimed in claim 8, wherein a depth of each fixed hole is larger than or equals to a length of each linking portion.

12. The fan as claimed in claim 8, wherein a shape of each fixed hole corresponds to a shape of each linking portion.

13. The fan as claimed in claim 8, wherein the linking portions and the top seat of the terminal seat are integrally formed as a single piece, or the linking portions and the bottom seat of the terminal seat are integrally formed as a single piece.

14. The fan as claimed in claim 8, wherein a width of the terminal seat is less than that of the accommodating portion.

15. The fan as claimed in claim 8, further comprising a motor electrically connected to the bipolar knife-shaped terminal.

16. The fan as claimed in claim 8, wherein the bipolar knife-shaped terminal comprises an electric conducting material.

17. The fan as claimed in claim 8, wherein the top seat and the bottom seat respectively comprise an opening, and the opening of the top seat corresponds to the bottom seat.

18. The fan as claimed in claim 17, wherein the plug further comprises a fixing element passing through the openings of the top seat and the bottom seat.

19. The fan as claimed in claim 18, wherein the fixing element is a screw or a bolt.

20. The fan as claimed in claim 8, wherein the fan is an axial fan.

* * * * *